US005917992A

United States Patent [19]

Zimmermann et al.

[11] Patent Number: 5,917,992

[45] Date of Patent: Jun. 29, 1999

[54] APPARATUS FOR THE LOOSENING OF WALLPAPER

[75] Inventors: Guido Zimmermann, Friedrichshafen; Jörn Lützeler, Daisendorf, both of Germany

[73] Assignee: J. Wagner GmbH, Friedrichshafen, Germany

[21] Appl. No.: 08/801,779

[22] Filed: Feb. 14, 1997

[30] Foreign Application Priority Data

Feb. 24, 1996 [DE] Germany ..... 196 07 095

[51] Int. Cl.[6] ..... A61H 33/12

[52] U.S. Cl. ..... 392/404; 392/406

[58] Field of Search ..... 392/379, 383, 392/384, 385, 404, 405, 406, 476, 477

[56] References Cited

U.S. PATENT DOCUMENTS

| | | | |
|---|---|---|---|
| 1,189,716 | 7/1916 | Matzke . | |
| 1,428,442 | 9/1922 | Lancaster | 392/404 |
| 1,674,237 | 6/1928 | Bauer | 392/404 |
| 2,137,876 | 11/1938 | Hudson | 392/404 |
| 2,226,426 | 12/1940 | Gallagher | 392/404 |
| 2,676,239 | 4/1954 | Sanzone et al. | 392/404 |
| 2,726,314 | 12/1955 | Prain | 392/404 |
| 2,998,924 | 9/1961 | Schaeffer | 392/404 |
| 3,997,759 | 12/1976 | Osrow et al. | 392/404 |
| 5,208,895 | 5/1993 | Hoover, Jr. et al. | 392/404 |
| 5,447,597 | 9/1995 | Zimmermann et al. | 392/404 |

FOREIGN PATENT DOCUMENTS

| | | | |
|---|---|---|---|
| 168375 | 4/1934 | Switzerland . | |
| 648957 | 1/1951 | United Kingdom . | |
| 2095981 | 10/1982 | United Kingdom | A47L 13/00 |
| 2227821 | 8/1990 | United Kingdom | F22B 1/28 |
| 2255005 | 10/1992 | United Kingdom | B44D 3/16 |

OTHER PUBLICATIONS

British Search Report, Apr. 2, 1997, 1 page, application No. GB97002240.

*Primary Examiner*—Teresa Walberg
*Assistant Examiner*—Sam Paik
*Attorney, Agent, or Firm*—Faegre & Benson LLP

[57] ABSTRACT

An apparatus for the loosening of wallpaper or the like from a substrate by steam. The apparatus includes a steam generator and a working plate, the steam generator being connected to the working plate by a flexible steam hose. The working plate is formed as a steam bar, which includes a U-shaped housing to which a handle is attached. A cover plate or a side piece can be detachably joined to the housing at one or both ends of the housing. The cover plate or side piece is closed at the end opposite the housing, and by choosing to attach either a cover plate or a side piece to the housing, the working area provided by the working plate can be adjusted. The apparatus thus provides a tool which can be easily and quickly adapted to loosen wallpaper in a variety of situations, including making it possible to steam both entire sheets of wallpaper and small portions of wallpaper in small areas where access to the wallpaper is poor. To facilitate the attachment and detachment of cover plate or side piece, a resilient snap catch is formed on the housing, the snap catch interacting with a stop provided on the cover plate and side piece.

6 Claims, 4 Drawing Sheets

APPARATUS FOR THE LOOSENING OF WALLPAPER

Figure 1:
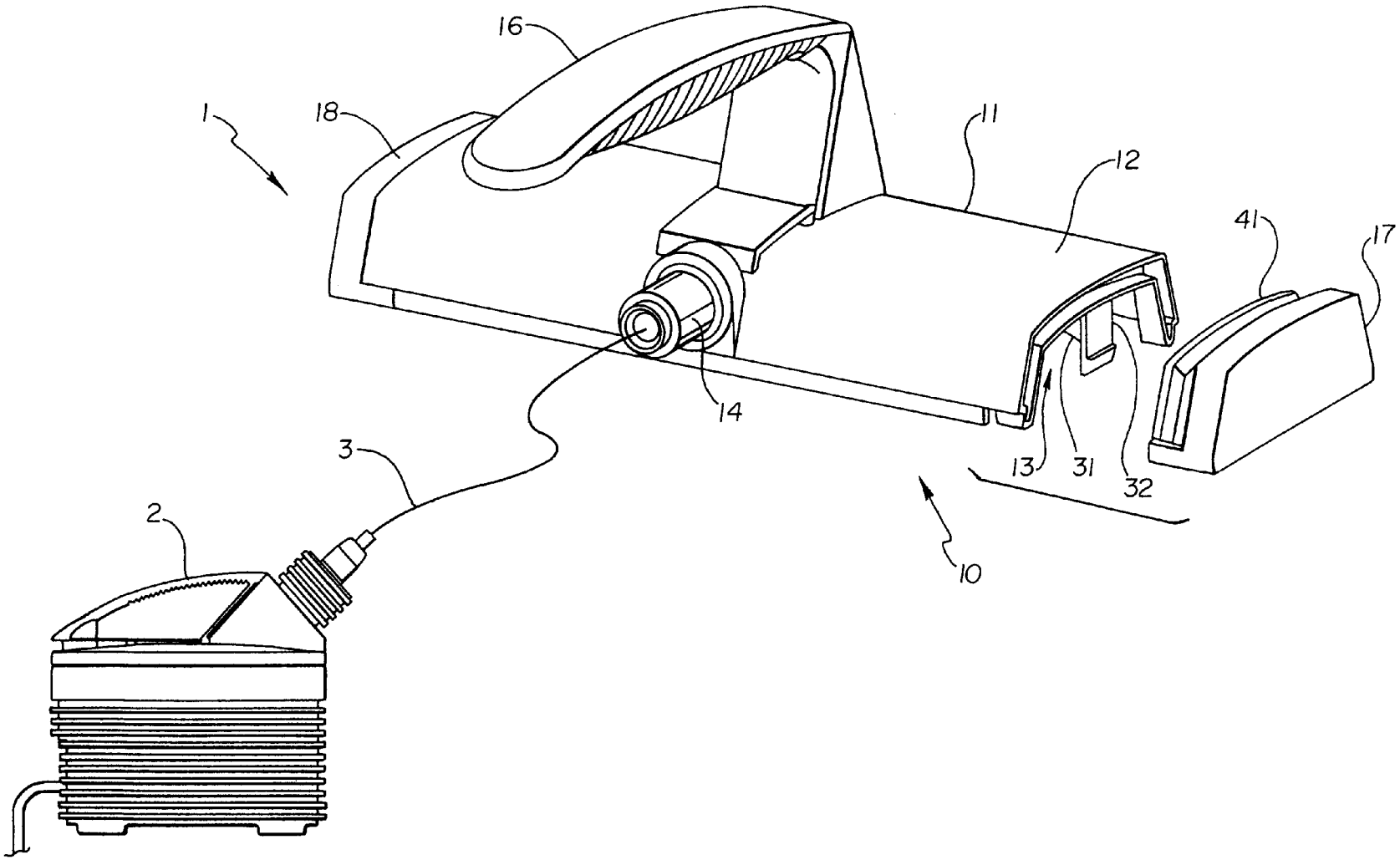

The invention relates to an apparatus for the loosening of wallpaper or the like from a substrate by means of steam, the apparatus being comprised of a steam generator and a working plate connected to it via a flexible steam hose, by means of which the steam can be supplied to the wallpaper.

DE 4 309 241 A1 and CH-PS 168 375 disclose wallpaper removal devices of this type which have proven successful in practical use. In these embodiments, the working plate is formed in one piece and is designed as a component extending in the longitudinal direction of the formed-on handle so that a sheet of wallpaper must be steamed a number of times across its breadth and cannot be removed in one operation. A further disadvantage is that the working plate is of relatively large size and consequently areas between a wall and a door frame cannot be worked, since in such cases the working plate cannot be set down completely flat and thus the supplied steam streams out the side.

U.S. Pat. No. 1,189,716 discloses a wallpaper removal device formed in a similar manner. In this case, the similarly one-piece working plate is connected to a heating element via a hose assembly and extends crosswise to the handle so that a larger area can indeed be steamed in one operation—provided steam can be obtained from the heating element—but this device also has the above-cited disadvantages. Therefore, a satisfactory working method as well as versatility of use are often not possible with the known devices.

The object of the invention is consequently to devise an apparatus for the loosening of wallpaper of the above-cited class which can easily and quickly be adapted to the different tasks to be completed at any time and without the necessity of technical knowledge. However, the primary objective is to make it possible not only to steam the entire width of a sheet of wallpaper but also to make it possible to work in poorly accessible places without difficulty. The constructional expense required for this should be kept low and easy operation with a high level of operating safety should also be assured.

In accordance with the invention, the apparatus for the loosening of wallpaper with which this is to be achieved is characterized by the fact that the working plate is formed as a steam bar provided with a handle having a U-shaped housing and that a cover plate adapted to its cross-section, or optionally a side piece adapted to the housing and closed in its end region opposite to the housing can be detachably joined to one or both of the faces of the housing in its longitudinal direction.

In this connection, it is expedient to equip the steam bar with a spreader unit placed in its housing in the region of the steam inlet opening; said spreader unit can designed as a crosspiece formed in the housing following a divergent course in its longitudinal direction.

For the detachable connection of the cover plates or the side pieces, it is further appropriate to provide an angular shaped bracket on the inside of each of the two end regions of the housing, each of said brackets having a projecting snap catch in its center, and to provide each of the cover plates and side parts with a formed-on flange encompassing the bracket. A recess for the insertion of the snap catch is incorporated into the flange and a stop that interacts with the snap catch is attached to it.

The snap catch can be formed as a resiliently deformable bar provided on the bracket having a beveled surface and a stop face interacting with a stop provided on the cover plates and the side pieces, in which the path of movement of the snap catch should be limited by a stop bar located on the housing at a lateral distance from the snap catch when the connection of a cover plate or of a side piece is loosened from the housing.

The stop provided on the flange of the cover plate and the side pieces is formed in a simple manner in each case by a projecting bar formed centrally on their ends facing the steam bar. The bar has a stop face interacting with the stop face of the snap catch and should be stiffened by one or more reinforcing ribs located on the side opposite the steam bar.

It is further advantageous to form the bracket provided on the housing of the steam bar as an angular connecting piece projecting into the interior space of the steam bar. The leg of said connecting piece that is connected with the housing is formed to incline in the direction of the cover plate or the side piece and its free leg is formed to follow a course parallel to the housing. The flange formed on the cover plates and on the side pieces has a clamping bar that interacts with the inclined leg of the connecting piece so that the parts to be joined mesh and the cover plates or the side pieces are centered in the housing of the steam bar.

The housing of the steam bar and each of the two side pieces to be attached to it should be of the same axial length.

If an apparatus for the loosening of wallpaper is designed in accordance with the invention, it is not only possible to steam a sheet of wallpaper in one operation, but also by removal of the side pieces it is possible to reduce the size of the working plate in such a way that it can also be used in poorly accessible places, however with the steam bar continuously lying flat on the surface to be steamed. It is thus possible to make adjustments to different circumstances without difficulty, since it is only necessary to loosen the snap catch to remove, for instance, one or both cover plates or latched side pieces and replace them by cover plates or side pieces. Consequently, it is possible for anyone to easily adapt the apparatus to changed working conditions in a short time.

The constructional and production expense needed to bring this about is extremely low, yet continuously reliable function with a high level of operating safety is assured. The apparatus for the loosening of wallpaper designed in accordance with the invention can consequently be used in an extremely versatile manner with easy handling.

Figure 4:
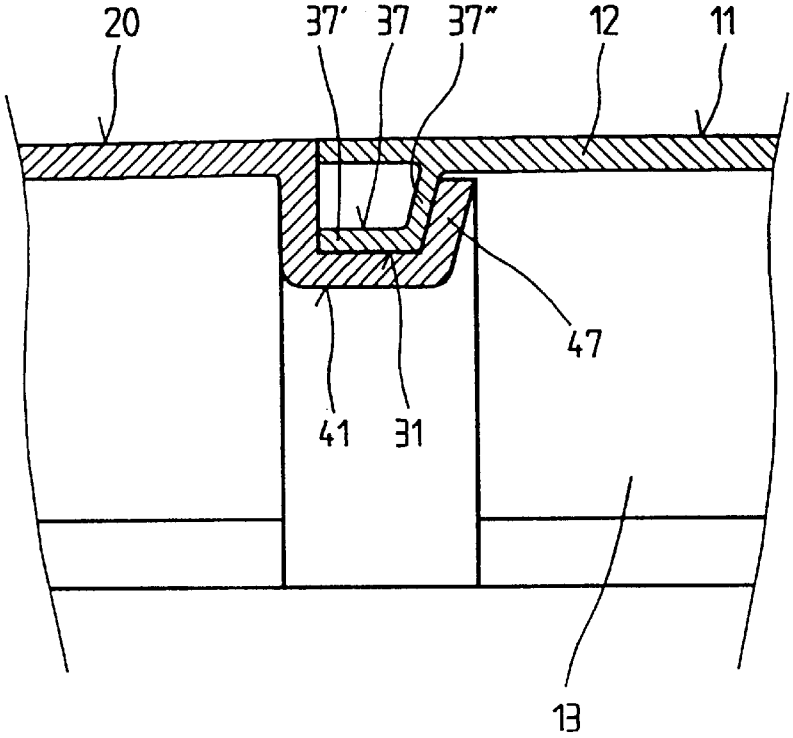
Figure 5:
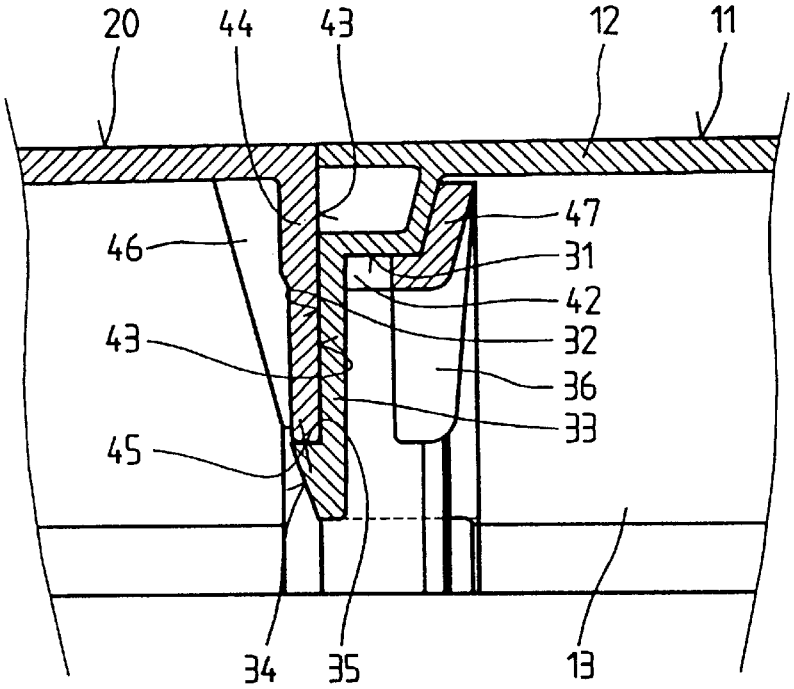

An exemplary embodiment of the apparatus for the loosening of wallpaper designed in accordance with the invention will be illustrated by way of the drawings and explained in greater detail below. In the drawings, FIG. 1 shows an apparatus comprised of a steam generator and a working plate, partly in side view and in a perspective view FIG. 2 shows the working plate according to FIG. 1 with two side pieces attached to the housing of the steam bar in a perspective view, FIG. 3 shows the working plate according to FIG. 2 from below, FIG. 4 shows a section following Line IV—IV of FIG. 3 and FIG. 5 shows a section following Line V—V of FIG. 3.

The apparatus shown in FIG. 1 and designated as 1 serves to loosen wallpaper or the like from a substrate by means of hot steam and is essentially comprised of a steam generator 2 and working plate 10 for the output of the steam, said working plate being connected to steam generator 2 via a flexible steam line 3. The hot steam produced in steam generator 2 and emerging from working plate 10 softens the wallpaper and loosens it from the wall so that it can be easily removed with a putty knife, for instance.

Figure 2:
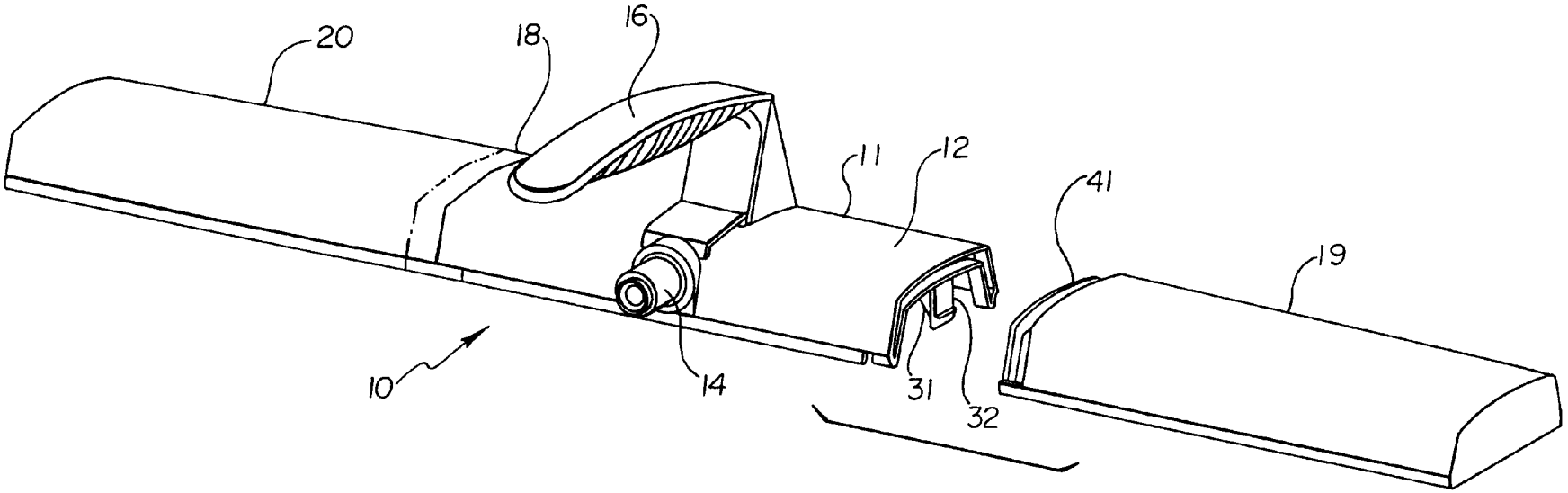
Figure 3:
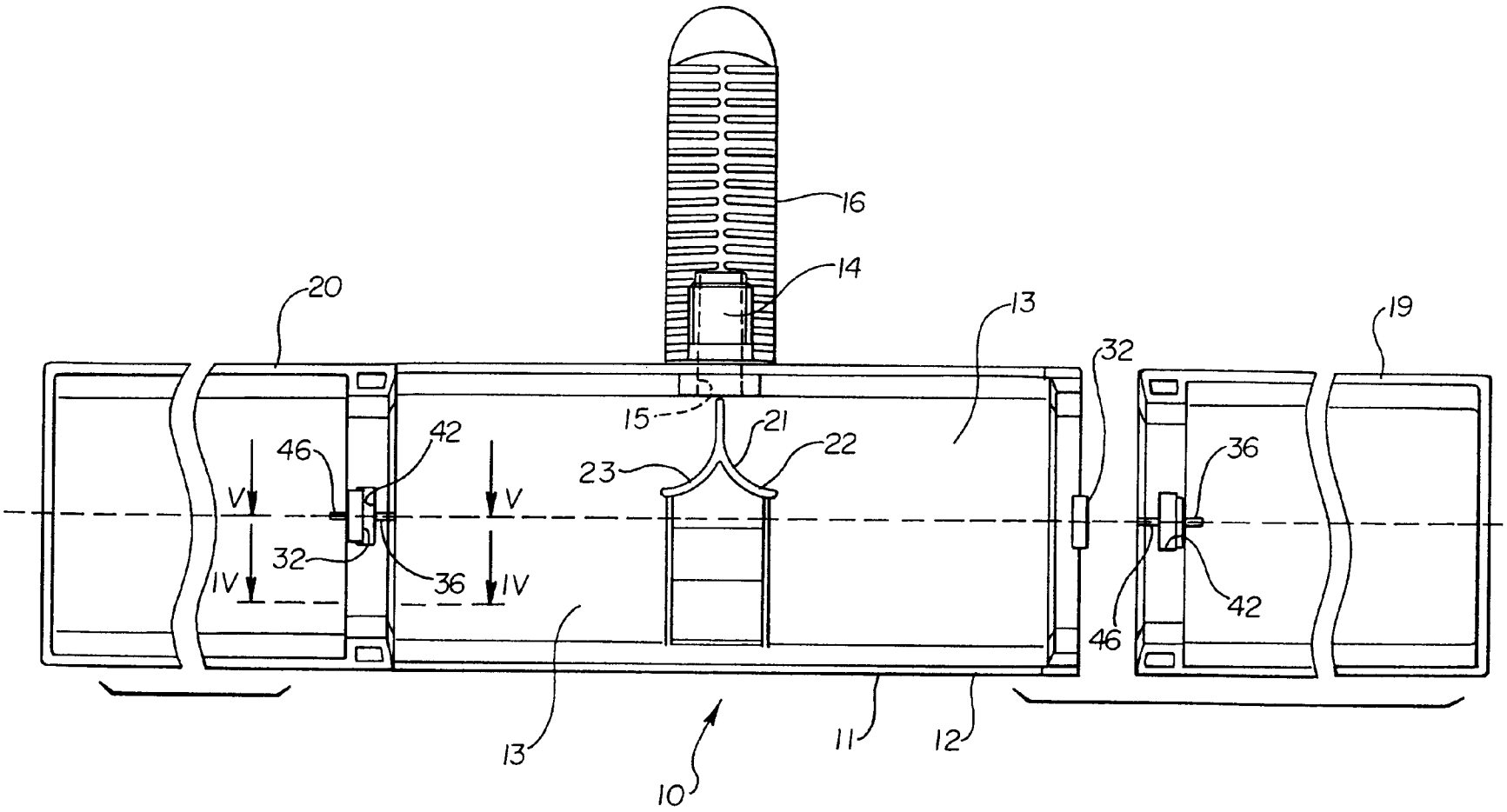

Working plate 10, as seen in FIGS. 2 and 3, is formed as a steam bar 11 which has a U-shaped housing 12 and is provided with a handle 16 in its center. A connecting piece 14 for the steam hose 3 is formed on housing 12 underneath handle 16 and is formed as inlet opening 15 in the interior space 13 of housing 12. According to FIG. 1, housing 12 of steam bar 11 can be closed on its sides with cover plates 17 and 18. However, according to FIGS. 2 and 3, side pieces 19 and 20 can be attached to one or both sides of housing 12 so that the working width of working plate 10 can be easily adapted to the particular circumstances. It is, however, also possible to provide a cover plate on one side of steam bar 11 and a side piece on the other side as shown by the dot-dash line in FIG. 2.

A spreader unit 21 is placed in front of inlet opening 15 to provide uniform distribution of the steam flowing into the interior space 13 of housing 12 via inlet opening 15. In this connection, the spreader unit 21 is comprised of two cross-pieces 22 and 23 following a divergent course toward the outside by which the inflowing steam is directed into the interior space 13 of housing 12 and into the connected side pieces 19 and 20.

Cover plates 17 and 18 or side pieces 19 and 20 can be optionally connected to housing 12 of steam bar 11. In order to make this possible, a bracket 31 is formed on both ends of housing 12, each at a distance from the housing, said bracket being provided with a resiliently deformable snap catch 32. And a flange 41 is attached to each of the cover plates 17 and 18 as well as the side pieces 19 and 20 which are adapted to the cross-sectional form of steam bar 11, said flange having a recess 42 to receive snap catch 32 as well as a stop 43 with which snap catch 32 interacts.

In the embodiment shown, as can be seen in FIG. 5, the snap catch 32 formed on flange[1] 31 is comprised of a resiliently deformable bar 33 which has a beveled surface 34 as well as a stop face 35 interacting with stop 43. Bar 33 has also been provided with a stop bar 36 projecting from bracket 31 at a distance from bar 33 so that bar 33 can only be deformed within limits.

Stop 43 provided on cover plates 17, 18 and side pieces 19, 20 is similarly formed by a bar 44 projecting to the interior, on the free end of which a stop face 45 interacting with snap catch 32 has been provided. Bar 44 is strengthened by a rib 46.

The flange 31[1] provided in the end regions of housing 12 is comprised of a angular connecting piece 37 which has a leg 37' running parallel to the housing and a leg 37" formed on it and inclined to the outside. And flange 41 is provided with a clamping bar 47 to match leg 37" with the result that bracket 31 is not only centered in flange 41 but it is also clamped in it by the meshing of snap catch 32 with stop 43.

[1][Translator's note: It appears this was intended to read "Bügel (bracket) 31.]

Starting from the operating position shown in FIG. 5, side piece 20 can be removed by the exertion of sufficient pressure on the beveled surface 43 to pivot snap catch 32 far enough to the right to loosen its engagement with stop 43. Side piece 20 can then be removed by pulling it away from the housing 12 of steam bar 11. If on the other hand, a cover plate 17 and/or 18 or one or both side pieces 19 and/or 20 is to be attached to housing 12, all that is necessary is for snap catch 32 to be inserted through the recess 42 provided in flange 41—at the same time, snap catch 32 is pivoted to the side by bar 42—and cover plate 17, 18 or side piece 19, 20 must be pushed sufficiently far that snap catch 32 engages stop 43. In this operating state, side piece 20 is again tightly clamped to housing 12.

By quickly and easily changing the cover plates 17 and/or 18 as well as side pieces 19 and/or 20, the steam bar 11 can be easily adapted to the particular tasks to be accomplished, since, for instance, it is possible to work in narrow spaces with cover plates 17 and 18 in place or the total width of sheets of wallpaper can be loosened by the steam supplied when both side pieces 19 and 20 are attached.

We claim:

1. Apparatus for the loosening of wallpaper from a substrate by means of steam, the apparatus including a steam generator and a working plate connected to it via a flexible steam hose, by means of which the steam can be supplied to the wallpaper, characterized by the fact that the working plate is formed as a steam bar provided with a handle having a U-shaped housing and that one of a cover plate and a side piece having a cross-section that matches the cross-section of the housing and closed in its end region opposite to the housing is detachably connected to at least one of the faces of housing in a longitudinal direction.

2. Apparatus in accordance with claim 1, characterized by the fact that the steam bar is provided with a spreader unit located in the region of a steam inlet opening of the housing.

3. Apparatus in accordance with claim 2, characterized by the fact that the spreader unit is formed as crosspieces formed on the housing, each following a divergent course in the longitudinal direction.

4. Apparatus in accordance with any one of claims 1 to 3, characterized by the fact that for the detachable connection of the one of the cover plate and the side piece to the housing of the steam bar, an angular shaped bracket is provided on the inside of each of the two end regions of housing, each of said brackets having a projecting snap catch in its center, and the one of the cover plate and the side piece is provided with a formed-on flange encompassing the bracket, said flange having a recess for the insertion of the snap catch and to which a stop that interacts with the snap catch is attached.

5. Apparatus in accordance with claim 4, characterized by the fact that the snap catch is formed as a resiliently deformable bar having a beveled surface and a stop face interacting with a stop provided on the one of the cover plate and the side piece.

6. Apparatus in accordance with claim 5, characterized by the fact that the path of movement of the snap catch is limited by a stop bar formed on the housing located at a lateral distance to the snap catch when the connection of the one of the cover plate the side piece is loosened from the housing.

* * * * *